US008201401B2

(12) United States Patent
Abram et al.

(10) Patent No.: US 8,201,401 B2
(45) Date of Patent: Jun. 19, 2012

(54) PASSIVE VALVE ASSEMBLY WITH NEGATIVE START ANGLE

(75) Inventors: Kwin Abram, Columbus, IN (US); Robin Willats, Columbus, IN (US)

(73) Assignee: Emcon Technologies, LLC, Wilmington, DE (US)

( * ) Notice: Subject to any disclaimer, the term of this patent is extended or adjusted under 35 U.S.C. 154(b) by 640 days.

(21) Appl. No.: 12/363,901

(22) Filed: Feb. 2, 2009

(65) Prior Publication Data

US 2010/0192559 A1 Aug. 5, 2010

(51) Int. Cl.
*F01N 1/00* (2006.01)

(52) U.S. Cl. ..... 60/324; 60/274; 60/291; 60/292; 137/115.16; 137/596.2; 251/305; 251/313

(58) Field of Classification Search ..... 60/272, 60/274, 291, 292, 324; 137/115.15, 115.16, 137/596.1, 596.2; 251/305, 313
See application file for complete search history.

(56) References Cited

U.S. PATENT DOCUMENTS 5,355,673 A * 10/1994 Sterling et al. ..... 60/324
6,698,717 B1 * 3/2004 Brookshire et al. ..... 251/305
6,817,172 B2 * 11/2004 Tamura ..... 60/285
7,121,088 B2 * 10/2006 Lavin ..... 60/324
7,328,574 B2 * 2/2008 Vignassa et al. ..... 60/324
7,451,854 B2 * 11/2008 Suzuki et al. ..... 181/237
7,536,990 B2 * 5/2009 Willats et al. ..... 123/323
7,775,322 B2 * 8/2010 Hill ..... 181/254
7,849,684 B2 * 12/2010 Gerards et al. ..... 60/324
2008/0029655 A1 2/2008 Mabuchi
2009/0019664 A1 1/2009 Abram

FOREIGN PATENT DOCUMENTS

KR 2019980060197 U 11/1998
KR 1020060055586 A 5/2006

OTHER PUBLICATIONS

Korean Search Report dated Jul. 13, 2010.

* cited by examiner

*Primary Examiner* — Binh Q Tran
(74) *Attorney, Agent, or Firm* — Carlson Gaskey & Olds

(57) ABSTRACT

A passive valve assembly for a vehicle exhaust system includes an exhaust component that defines an exhaust gas flow path and a vane that is positioned within the exhaust gas flow path. The vane is positioned at an initial start position and is movable between a closed position to provide a minimum exhaust gas flow and an open position to provide a maximum exhaust gas flow. The start position is orientated at a negative angle relative to the closed position.

19 Claims, 1 Drawing Sheet

PASSIVE VALVE ASSEMBLY WITH NEGATIVE START ANGLE

TECHNICAL FIELD

The subject invention relates to a passive valve assembly in a vehicle exhaust system, and more particularly to a passive valve assembly that has a negative start angle to reduce valve flutter.

BACKGROUND OF THE INVENTION

Exhaust systems are widely known and used with combustion engines. Typically, an exhaust system includes exhaust tubes that convey hot exhaust gases from the engine to other exhaust system components, such as mufflers, resonators, etc. Mufflers and resonators include acoustic chambers that cancel out sound waves carried by the exhaust gases. Although effective, these components are often relatively large in size and provide limited nose attenuation.

Attempts have been made to improve low frequency noise attenuation by either increasing muffler volume or increasing backpressure. Increasing muffler volume is disadvantageous from a cost, material, and packaging space perspective. Increasing backpressure can adversely affect engine power.

Another solution for reducing low frequency noise is to use a passive valve assembly. One disadvantage with a traditional passive throttling valve configuration is a phenomena referred to as "flutter." Valve flutter is associated with pressure fluctuations (pressure pulses) as the passive valve begins to open, i.e. moves from a fully closed position toward an open position.

The passive valve includes a flapper valve body or vane that is positioned within the exhaust pipe, with the vane being pivotable between open and closed positions. The closed position comprises a start position for the valve where the valve body is orientated to be perpendicular to an exhaust gas flow direction. The passive valve is spring biased toward the closed position and includes a valve top to define a rest/closed position for the valve. When exhaust gas pressure is sufficient to overcome this spring bias, the vane is pivoted toward the open position.

Valve flutter results when the pressure that contributes to the opening of the valve is decreased as the valve opens. The decrease in pressure can contribute to a reduction in valve opening force, leading to the spring biasing force returning the valve to the closed position. A subsequent pressure pulse (an increase in pressure subsequently followed by a decrease in pressure) results in the flapper valve body beginning to open in response to the increase in pressure immediately followed by closing movement in response to the decrease in pressure. When a series of these pressure pulses are generated, such as when the engine is operating a low speeds for example, the valve "flutters" back and forth between opening and closing. This can result in undesirable noise generation as the flapper valve body impacts the valve stop during each closing movement. Further, these multiple impact events can cause pre-mature wear on the valve body.

SUMMARY OF THE INVENTION

A passive valve assembly for a vehicle exhaust system includes a vane that is orientated at a negative start angle to reduce the effect of valve flutter.

In one example, the passive valve assembly is associated with an exhaust component that defines an exhaust gas flow path. The passive valve assembly includes a vane that is positioned within the exhaust gas flow path at an initial start position. The vane is movable between a closed position to provide a minimum exhaust gas flow and an open position to provide a maximum exhaust gas flow. The start position is orientated at a negative angle relative to the closed position.

In one example, a vertical plane is defined that is perpendicular to a direction of exhaust gas flow. The vane is coplanar with the vertical plane when in the closed position, and is orientated at a positive angle relative to the vertical plane when moving from the closed position toward the open position. The vane is orientated at a negative angle relative to the vertical plane when moving from the start position toward the closed position.

In one example, the negative angle is defined within a range of three to ten degrees. A negative angle of at least three degrees avoids an undesirable vertical start position due to tolerance stack-ups of the various components.

These and other features of the present invention can be best understood from the following specification and drawings, the following of which is a brief description.

DETAILED DESCRIPTION OF THE PREFERRED EMBODIMENT

Figure 1:
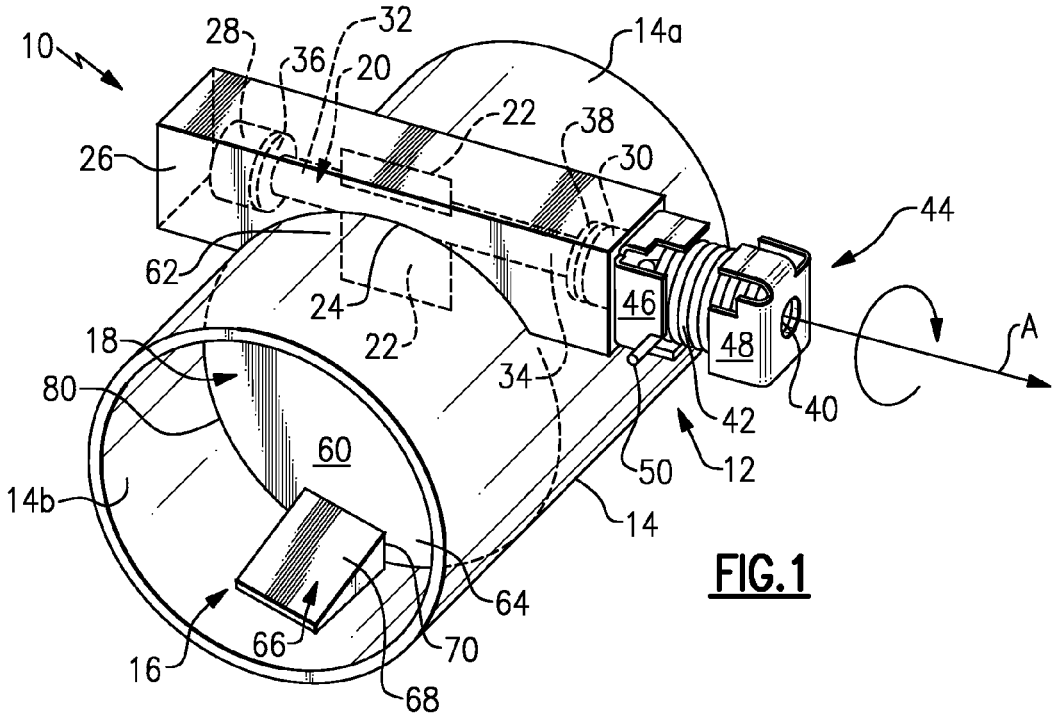
FIG. 1 shows a perspective view of one example of an exhaust component and passive valve assembly.

As shown in FIG. 1, an exhaust component, such as an exhaust tube or pipe 10 includes an exhaust throttling valve, referred to as a passive valve assembly 12. The passive valve assembly 12 is movable between an open position where there is minimal blockage of an exhaust gas flow path 16 and a closed position where a maximum portion of the exhaust gas flow path 16 is blocked. The passive valve assembly 12 is resiliently biased toward the closed position and is solely moved toward the open position when exhaust gas flow generates a pressure sufficient enough to overcome the biasing force.

In the example shown, the exhaust pipe 10 comprises a single pipe body 14 that defines the exhaust gas flow path 16. In one example, the pipe body 14 includes a curved outer surface 14*a* and a curved inner surface 14*b* that defines the exhaust gas flow path 16. In one example, the pipe body 14 has a circular cross-section; however, the pipe body could have other cross-sectional shapes depending upon the vehicle application and/or packaging space constraints.

The passive valve assembly 12 includes a valve body or vane 18 that blocks a maximum portion of the exhaust gas flow path 16 when in the closed position. As discussed above, the vane 18 is pivoted toward the open position to minimize blockage of the exhaust gas flow path 16 in response to pressure exerted against the vane 18 by exhaust gases.

In one example, the vane 18 is fixed to a shaft 20 with a connecting arm, shown schematically at 22 in FIG. 1. A slot 24 is formed within the curved outer surface 14*a* of the pipe body 14. A housing 26, shown in this example as a square metal structure, is received within this slot 24 and is welded to the pipe body 14. Other housing configurations could also be used. The shaft 20 is rotatably supported within the housing 26 by first 28 and second 30 bushings or bearings and defines an axis of rotation A.

The first bushing 28 is positioned generally at a first shaft end 32. The first bushing 28 comprises a sealed interface for the first shaft end 32. The shaft 20 includes a shaft body 34 that has a first collar 36 and a second collar 38. The first bushing 28 includes a first bore that receives the first shaft end 32 such that the first collar 36 abuts directly against an end face of the first bushing 28 to provide a sealed interface. As such, exhaust gases cannot leak out of the first bushing 28 along a path between the shaft 20 and first bushing 28.

The second bushing 30 includes a second bore through which the shaft body 34 extends to a second shaft end 40. The second collar 38 is located axially inboard of the second bushing 30. The shaft 20 extends through the second bore to an axially outboard position relative to the second bushing 30. A resilient member, such as a spring 42 for example, is coupled to the second shaft end 40 with a spring retainer 44. The spring retainer 44 includes a first retainer piece 46 that is fixed to the housing 26 and a second retainer piece 48 that is fixed to the second shaft end 40. One spring end 50 is associated with housing 26 via the first retainer piece 46 and a second spring end (not viewable in FIG. 1 due to the spring retainer 44) is associated with the shaft 20 via the second retainer piece 48.

The vane 18 comprises a body structure 60, such as a disc-shaped body for example, which includes a first portion 62 that is coupled to the shaft 20 with the connecting arm 22. The body structure 60 extends from the first portion 62 to a second portion that comprises a distal tip 64. As such, the tip 64 comprises a portion of the body structure 60 that is furthest from the axis of rotation A.

In the example shown, the disc-shaped body comprises a circular disc; however, the disc-shaped body could comprise any type of shape. However, an outer periphery 80 of the vane 18 should closely match in contour and size, a shape defined by an inner wall surface 82 of the exhaust component. Thus, when the vane 18 is in the closed position almost all exhaust gas flow will be blocked.

A stop 66 is supported by the pipe body 14 and is positioned within the exhaust gas flow path 16. The stop 66 defines a rest or starting position for the vane 18. The starting position is different than the closed position, with the starting position of the vane 18 being orientated at a negative angle relative to the closed position (see FIG. 2). The tip 64 of the vane 18 engages the stop 66 when the spring 42 returns the vane 18 from the open position to the start position. When exhaust gas flow is sufficient to overcome the biasing force of the spring 42, the vane 18 moves from the start position toward the closed position, and if the sufficient pressure is maintained, will move past the closed position toward the open position.

If the vane 18 is being subjected to pressure pulses that cause the vane to exhibit fluttering movement, due to the negative angle orientation of the vane at the starting position, the fluttering movement will be centered around the vertical closed position without resulting in contact between the vane 18 and the stop 66. This reduces noise as well as reducing wear on the vane 18.

Figure 2:
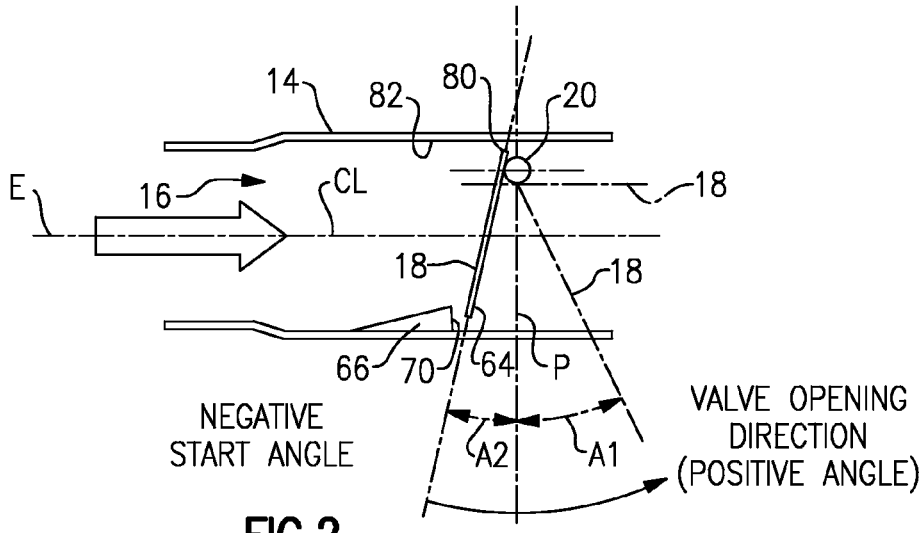
FIG. 2 shows a side view of an exhaust component with a stop for a vane.

As shown in FIG. 2, the exhaust component defines a vertical plane P that is perpendicular to a pipe centerline CL which corresponds to a direction of exhaust gas flow E. The vane 18 is co-planar with the vertical plane P when in the closed position and is orientated at a positive angle Al relative to the vertical plane P when moving from the closed position toward the open position. The vane 18 is orientated at a negative angle A2 relative to the vertical plane P when moving from the start position toward the closed position. Thus, when the vane 18 is in the closed position, the vane 18 is perpendicular to exhaust gas flow, and when the vane is in a fully open position the vane 18 is generally parallel to exhaust gas flow.

The negative angle A2 at the start position is at least three degrees. This avoids an undesirable vertical start position due to tolerance stack-ups of the various components. In one example, the negative angle A2 is within the range of three to ten degrees.

As shown in FIGS. 1-2 the stop 66 is positioned upstream of the vane 18 to define the start position. As such, a stop surface 70 on the stop 66 is spaced apart from the vane 18 when the vane is in the closed position. This position of the stop 66 allows the valve to exhibit fluttering movement without contacting the stop 66 and generating undesirable noise and wear.

Figure 3:
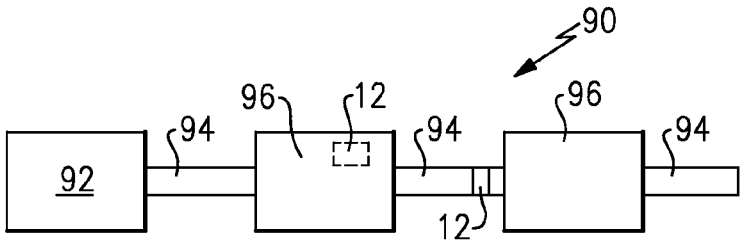
FIG. 3 is a schematic view of the exhaust component and passive valve assembly of FIG. 1 within an exhaust system.

The subject passive valve assembly can be located anywhere within an exhaust system 90 as schematically shown in FIG. 3. The exhaust system 90 directs exhaust gases from an engine 92 through various exhaust tubes or pipes 94 and through various exhaust components 96, such as mufflers, resonators, converters, by-passes, etc. The valve assembly 12 can be located in one or more of any of these pipes 94 and components 96 as needed to attenuate low frequency noise.

As discussed above, the negative start angle of the vane 18 provides noise and wear reduction. The initial opening behavior of such a vane 18 results in a decrease in flow cross-section area, which causes a rise in the pressure upstream of the vane 18, and which thus avoids the pressure loss that causes flutter. When the vane 18 has passed through the position where the vane 18 is perpendicular to a pipe centerline (coplanar with the vertical plane P), the flow area will increase. This is acceptable behavior at this point of opening because any oscillation about the part open position will not result in impact on the stop 66.

Although an embodiment of this invention has been disclosed, a worker of ordinary skill in this art would recognize that certain modifications would come within the scope of this invention. For that reason, the following claims should be studied to determine the true scope and content of this invention.

What is claimed is:

1. A passive valve assembly for a vehicle exhaust system comprising:

a vertical plane that is perpendicular to a direction of exhaust gas flow;

a vane to be positioned within an exhaust gas flow path at a start position, said vane being movable between a closed position to provide a minimum exhaust gas flow and an open position to provide a maximum exhaust gas flow, and wherein said vane is co-planar with said vertical plane when in said closed position and wherein said vane is orientated at a positive angle relative to said vertical plane when moving from said closed position toward said open position, and wherein said vane is orientated at a negative angle relative to said vertical plane when moving from said start position toward said closed position.

2. The passive valve assembly according to claim 1 wherein said negative angle is at least three degrees.

3. The passive valve assembly according to claim 2 wherein said negative angle is no larger than 10 degrees.

4. The passive valve assembly according to claim 1 wherein said vane is resiliently biased by a resilient member to return to said start position and wherein said vane is solely movable toward said open position in response to exhaust gas pressure sufficient to overcome a biasing force of said resilient member.

5. A passive valve assembly for a vehicle exhaust system comprising:

an exhaust component having an inner wall surface defining an exhaust gas flow path;

a shaft supported by a wall of said exhaust component, said shaft defining an axis of rotation;

a vane positioned within the exhaust gas flow path at a start position, said vane being pivotable about said axis of rotation between a closed position to provide a minimum exhaust gas flow and an open position to provide a maximum exhaust gas flow, and wherein said vane has an upstream edge and a downstream edge when in said closed position, said axis of rotation being located adjacent said downstream edge, and wherein said start position is orientated at a negative angle relative to said closed position; and a resilient member that provides a resilient biasing force to return said vane to said start portion and wherein said vane is solely movable toward said open position in response to exhaust gas pressure sufficient to overcome a biasing force of said resilient member.

6. The passive valve assembly according to claim 5 including a vertical plane that is perpendicular to a direction of exhaust gas flow and wherein said vane is co-planar with said vertical plane when in said closed position and wherein said vane is orientated at a positive angle relative to said vertical plane when moving from said closed position toward said open position, and wherein said vane is orientated at a negative angle relative to said vertical plane when moving from said start position toward said closed position.

7. The passive valve assembly according to claim 6 wherein said negative angle is at least three degrees.

8. The passive valve assembly according to claim 7 wherein said negative angle is no larger than 10 degrees.

9. The passive valve assembly according to claim 6 wherein said vane comprises a disc-shaped body having an outer periphery that generally conforms in shape to a shape bounded by said inner wall surface of said exhaust component, said outer periphery of said disc-shaped body being closely positioned relative to said inner wall surface when in said closed position such that almost all exhaust gas flow is blocked when said vane is in said closed position.

10. A passive valve assembly for a vehicle exhaust system composing:

an exhaust component having an inner wall surface defining an exhaust gas flow path;

a shaft supported by a wall of said exhaust component, said shaft defining an axis of rotation;

a vane positioned within the exhaust gas flow path at a start position, said vane being pivotable about said axis of rotation between a closed position to provide a minimum exhaust gas flow and an open position to provide a maximum exhaust gas flow, and wherein said start position is orientated at a negative angle relative to said closed position;

a resilient member that provides a resilient biasing force to return said vane to said start portion and wherein said vane is solely movable toward said open position in response to exhaust gas pressure sufficient to overcome a biasing force of said resilient member;

a vertical plane that is perpendicular to a direction of exhaust gas flow and wherein said vane is co-planar with said vertical plane when in said closed position and wherein said vane is orientated at a positive angle relative to said vertical plane when moving from said closed position toward said open position, and wherein said vane is orientated at a negative angle relative to said vertical plane when moving from said start position toward said closed position; and a valve stop supported by said exhaust component, said valve stop being located to define said start position.

11. The passive valve assembly according to claim 10 wherein a stop surface on said valve stop is spaced apart from said vane when said vane is in said closed position.

12. A method of operating a passive valve assembly comprising the steps of:

defining a vertical plane that is perpendicular to a direction of exhaust gas flow;

orientating a vane to be co-planar with the vertical plane when in a closed position;

orientating the vane at a positive angle relative to the vertical plane when moving from the closed position toward an open position;

resiliently biasing the vane toward a start position that is orientated at a negative angle relative to the vertical plane; and moving the vane from the start position toward the open position solely in response to exhaust gas flow pressure sufficient to overcome a resilient biasing return force.

13. The method according to claim 12 including orientating the negative angle within a range of three to ten degrees.

14. The method according to claim 12 positioning a stop adjacent a distal tip of the vane to define the start position.

15. The method according to claim 14 including configuring a stop surface on the stop to be spaced apart from contact with the vane when the vane is in the closed position.

16. The method according to claim 12 wherein the vane is pivotable about an axis, and wherein the vane has an upstream edge and a downstream edge when in the closed position, an including locating the axis adjacent the downstream edge.

17. The passive valve assembly according to claim 1 wherein said vane is pivotable about an axis, and wherein said vane has an upstream edge and a downstream edge when in said closed position, said axis being located adjacent said downstream edge.

18. The passive valve assembly according to claim 17 wherein said vane comprises a single-piece disc body that extends from said upstream edge to said downstream edge.

19. The passive valve assembly according to claim 1 including a valve stop supported by said exhaust component, said valve stop being located to define said start position, and wherein a stop surface on said valve stop is spaced apart from said vane when said vane is in said closed position.

* * * * *